United States Patent [19]

Roethe

[11] 4,173,949

[45] Nov. 13, 1979

[54] FEEDWATER PREHEAT CORROSION CONTROL SYSTEM

[75] Inventor: Lester A. Roethe, Tulsa, Okla.

[73] Assignee: Tranter, Inc., Tulsa, Okla.

[21] Appl. No.: 871,212

[22] Filed: Jan. 23, 1978

[51] Int. Cl.[2] ..... F22D 1/02

[52] U.S. Cl. ..... 122/1 C; 122/412; 122/421

[58] Field of Search ..... 122/1 R, 1 C, 412, 420, 122/421

[56] References Cited

U.S. PATENT DOCUMENTS

| | | | |
|---|---|---|---|
| 3,910,236 | 10/1975 | Merritt, Jr. | 122/421 |
| 4,089,304 | 5/1978 | Beckmann | 122/412 |

*Primary Examiner*—Kenneth W. Sprague
*Attorney, Agent, or Firm*—William S. Dorman

[57] ABSTRACT

An improved arrangement for preheating feedwater in a steam boiler system prior to the feedwater entering a fuel economizer in order to prevent corrosion due to condensation of flue gas in the fuel economizer and in the exhaust of the boiler system. The feedwater, prior to entering the fuel economizer, is heated in a preheater with a portion of steam from a boiler. The amount of steam entering the preheater is regulated by two temperature control valves. A first temperature control valve is regulated by the temperature of the feedwater prior to entering the fuel economizer. A second temperature control valve is regulated by the temperature of the flue gas in the boiler exhaust stack.

2 Claims, 3 Drawing Figures

FEEDWATER PREHEAT CORROSION CONTROL SYSTEM

BACKGROUND OF THE INVENTION

1. Field of the Invention

This invention relates to a method and means of preventing corrosion in a steam boiler system. More particularly, this invention relates to an improved, efficient method and means of preventing corrosion due to condensation of flue gas within the fuel economizer and within the exhaust stack of the steam boiler system.

2. Description of the Prior Art

Fuel economizers, or similar heat recovery devices, are well-known devices used to reduce the amount of fuel necessary to convert feedwater into steam in boiler systems by extracting waste heat from flue gas. Because of the energy crisis, industry needs the fuel savings that economizers can offer.

One problem, however, with the use of a fuel economizer in a boiler system is that corrosive acids can condense out of the flue gas inside the economizer if the temperature of the flue gas from the boiler drops below certain dew points. Condensation of acid vapors from the flue gas is the result of the flue gas contacting the metal heating surfaces in the boiler economizer. Since the temperature of the metal heating surfaces (the tube wall and the related finning) in contact with the flue gas is more nearly that of the feedwater than the flue gas, there are two items that should be analyzed; first, the sulfur content of the fuel being burned and, second, the temperature of the feedwater at the inlet of the economizer.

Another problem that this invention addresses is exhaust stack corrosion. The temperature of the metal, or stack wall, in contact with the exit flue gas determines the extent of acid corrosion due to condensation.

One way to reduce corrosion is to use metals with a greater amount of corrosion resistance. This may, however, be expensive and not totally effective. Another solution that has been tried is to regulate the amount of feedwater flowing through the economizer and bypassing the economizer at times in response to a temperature control valve. Such a system has been attempted in Merrit, Jr., U.S. Pat. No. 3,910,236. Bypassing feedwater at low load conditions creates a very real potential for steam formation within the economizer tubing which is not designed to be a steam generator. More importantly, bypassing feedwater at low load conditions does not prevent corrosion near the inlet of the economizer since the tube metal temperature determines the extent of acid corrosion and the feedwater temperature determines the tube metal temperature.

Therefore, it is a principal object and purpose of this invention to provide a method of preventing corrosion within both the boiler economizer and the exhaust stack of the boiler system using a thermostatically controlled feedwater preheat system.

SUMMARY OF THE INVENTION

The present invention provides a feedwater preheat system for corrosion prevention in both fuel economizer and the exhaust stack of a steam boiler system. The fuel economizer, a heat exchanger mounted in the exhaust stack of the boiler, recovers heat from the exhaust gases that would otherwise be wasted.

Feedwater is sent from a deaerating heater into a preheater heat exchange. After the feedwater has been heated in the preheater, it passes into the fuel economizer through a conduit. Flue gas is the heating medium in the boiler economizer and the feedwater recovers some of the heat from the flue gas as it passes through the boiler economizer. Finally, the feedwater travels to the boiler via conduit where it is converted into steam.

A portion of the steam from the boiler is used as the heating medium for the preheater and is carried to the preheater via conduit. After the steam has passed through the preheater and some of the heat has been removed, the resulting condensate is carried to the deaerating heater and the cycle is complete.

The amount of steam required to maintain the correct feedwater temperature to insure maximum heat transfer and minimum corrosion is regulated by two temperature control valves in parallel arrangement. One control valve, for preventing corrosion in the boiler economizer, is regulated by the temperature of the feedwater prior to entering the boiler economizer. The other control valve, for preventing corrosion in the exhaust stack, is regulated by the temperature of the flue gas in the exhaust stack behind the economizer.

DETAILED DESCRIPTION OF THE PREFERRED EMBODIMENTS

Figure 1:
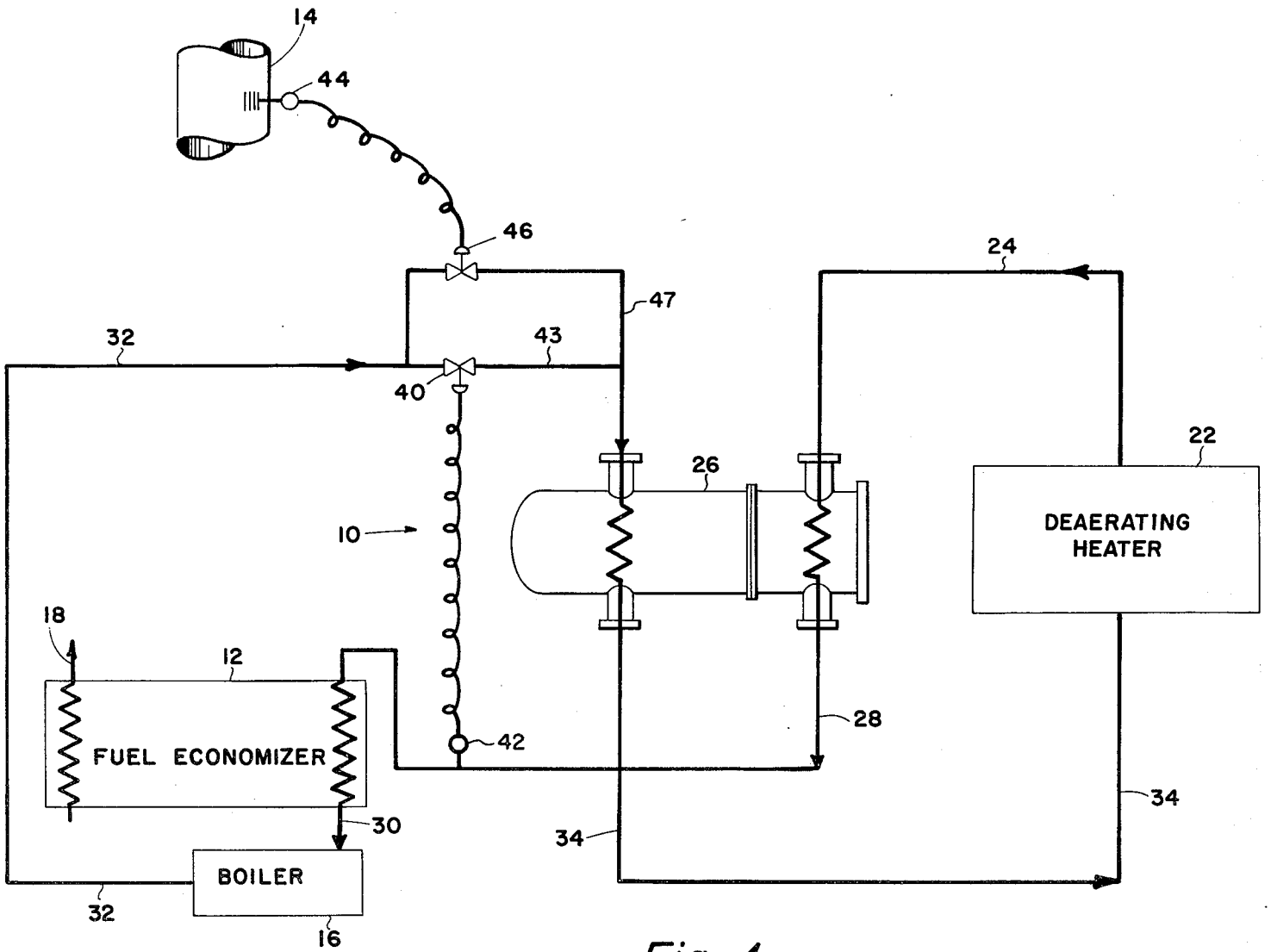
FIG. 1 is a semi-diagrammatic or schematic representation of the feedwater preheat system embodied in the present invention.

Referring to the drawings in detail, FIG. 1 shows a schematic representation of a feedwater preheat system 10 for corrosion prevention to be used in conjunction with a fuel economizer 12 and a boiler exhaust stack 14 (the latter being shown in reduced size for ease of illustration). The boiler economizer is a heat exchanger which is mounted in the exhaust stack 14 of a furnace or boiler 16 for the purpose of recovering heat from the exhaust or flue gas 18. Feedwater 20 (not shown in FIG. 1) from a deaerating heater 22 is pumped through conduit 24 into a preheater 26. The preheater can be a shell and tube type heat exchanger. The deaerating heater 22 is used in the boiler system to remove some of the dissolved oxygen in the feedwater 20 because of the possible corrosive effect of oxygen in a high-pressure boiler. The feedwater travels from the preheater 26, after it has been heated, into the fuel economizer 12 through conduit 28.

Figure 2:
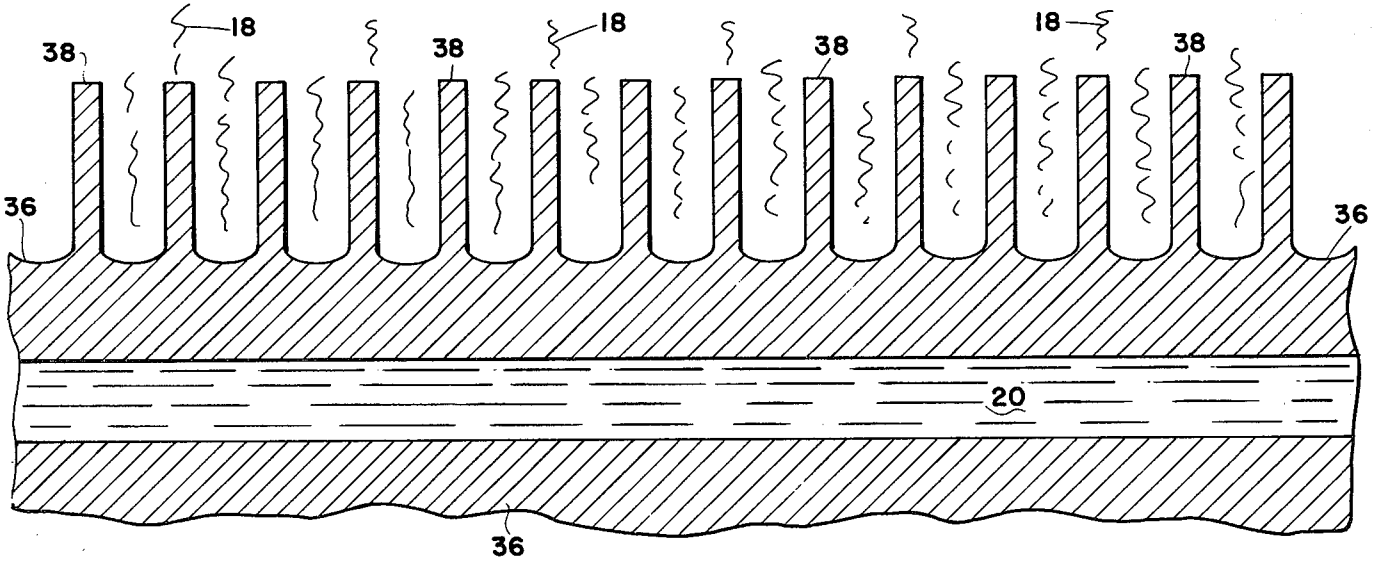
FIG. 2 illustrates a cut-away view of a finned tube used in the fuel economizer in FIG. 1 indicating the flue gas with curved lines.

In the fuel economizer 12, after recovering some of the heat from the flue gas 18, the feedwater 20 travels to the boiler 16 via conduit 30. A more precise showing of the flue gas-to-feedwater heat transfer mechanism is shown in FIG. 2. The steam (not shown) supplied by the boiler or furnace 16 is carried to the preheater 26 through conduit 32 and is the heating medium for the preheater. After the steam has passed through the preheater 26, and some of the heat is removed, the condensate (not shown) that results is carried to the dearating heater 22 via conduit 34.

Oil, natural gas, and coal, the primary combustion materials used in most boilers, all contain the elements carbon and hydrogen. They may also contain a certain amount of sulphur. Hydrogen will combine with oxygen to form water vapor. If sulphur is present in the fuel it will combine with oxygen to form sulphur dioxide ($SO_2$). Generally, approximately 1% to 2% of the sulphur dioxide is further oxidized into sulphur trioxide ($SO_3$). Sulphur dioxide will dissolve in any free moisture that may be present in the flue gas to form sulphurous acid ($H_2SO_3$) and sulphur trioxide will combine with super heated water vapor to form sulphuric acid ($H_2SO_4$) vapor. Both of these acids are powerful corrosives.

FIG. 2 shows a cross-section of a part of a finned tube 36 used in the fuel economizer 12. Flue gas 18 passes over the outside of the tube 36 and around finning 38 on the tube while feedwater 20 passes through the inside of the tube 36. One of the problems which this invention addresses occurs at the point where the feedwater 20 enters the fuel economizer 12. This is known as the "cold end corrosion." Condensation of the acid vapors from the flue gas 18 is the result of the flue gas contacting the metal heating surfaces in the boiler economizer 12.

The temperature at which moisture begins to condense out of a gas is known as the dew point. Determining the dew point makes it possible to calculate when $SO_2$ and $SO_3$ vapors in the flue gas form the corrosive acids. Condensation of the acid vapors from the flue gas 18 is the result of the flue gas contacting the metal heating surfaces in the boiler fuel economizer 12. The temperature of the tube wall 36 and the finning 38 in contact with the flue gas is more nearly that of the feedwater 20 than the flue gas 18. This is due to the greater resistance to heat transfer on the gas side than on the water side. It is, therefore, the temperature of the tubing 36 and the finning 38, not the average temperature of the flue gas as it exits from the economizer 12, that determines whether or not corrosive acids will condense out of the gas as it passes through the economizer.

It is recognized that while a higher feedwater temperature will yield a greater margin of safety, it will also yield lesser heat transfer in the fuel economizer 12. In other words, it is important to maintain the correct feedwater temperature to insure maximum heat transfer and minimum corrosion.

Figure 3:
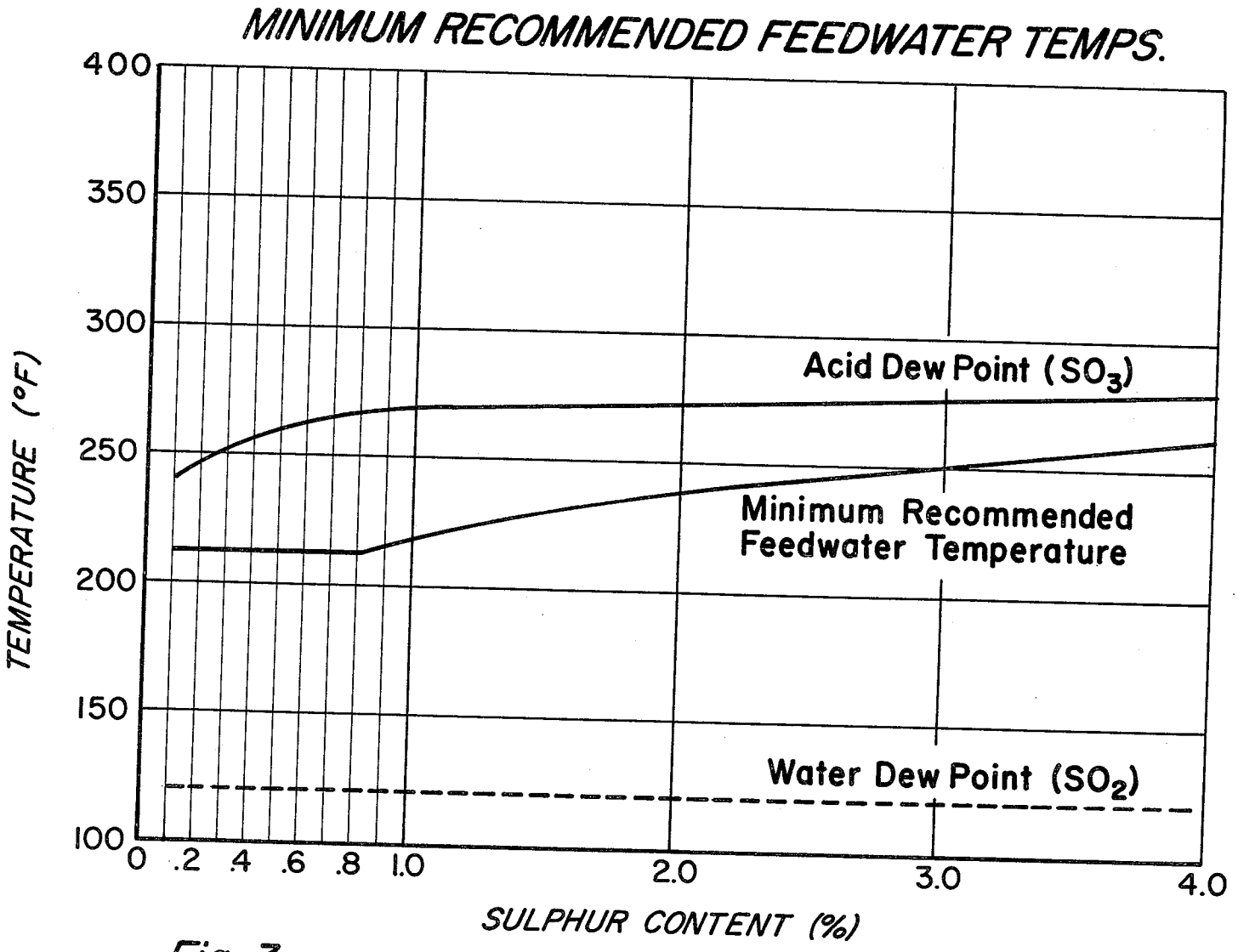
FIG. 3 is a graph indicating the minimum recommended feedwater temperatures for boiler systems where fuels with various sulfur contents are used.

When analyzing requirements for installation of a fuel economizer, or similar heat recovery device, there are two important factors that must be considered; first, the sulfur content of the fuel being burned and, second, the temperature of the feedwater at the inlet of the fuel economizer. FIG. 3 illustrates the relationship between the two factors. The data presented in the chart is based on information derived from low temperature corrosion studies conducted by the Petroleum Engineering School of the University of Tulsa. Sulphur dioxide will form sulphurous acid when it can dissolve in free moisture in the flue gas, or the "water dew point." When $SO_3$ combines with super heated water vapor to form sulphuric acid vapor, the formation of sulphuric acid ($H_2SO_4$) begins to occur at what is known as the "acid dew point." The variables that determine both the formulation of $H_2SO_4$ vapor and its dew point include the amount of excess air in combustion, the moisture content of the gas, and the amount of sulphur in the fuel.

When sulphur dioxide ($SO_2$) gases pass through the economizer, the minimum feedwater temperatures indicated in FIG. 3 will maintain the metal surfaces of the heating elements well above the water dew point and eliminate the possibility of sulphurous acid ($H_2SO_3$) corrosion.

Concerning sulphur trioxide ($SO_3$) gases and sulphuric acid ($H_2SO_4$) formation, studies indicate that relatively little condensation takes place at the acid dew point. Maximum condensation does not occur until temperatures are approximately eighty degrees Fahrenheit to one hundred degrees Fahrenheit below the acid dew point. Also, less than 2% of the sulphur dioxide in the flue gas is converted to sulphur trioxide.

It is important to note that in the present invention the amount of steam required for proper preheat is regulated by a pair of temperature control valves in parallel arrangement, as best seen in FIG. 1. One valve 40 is controlled by a heat sensitive thermostat 42 in the conduit 28 downstream from the preheater 26 so as to supply steam to the preheater 26 through the conduit 43. The control valve 40 can be set for a desired feedwater temperature and that temperature will be maintained at all rates of flow, thus eliminating the possibility of corrosion in the boiler economizer 12.

The second problem which this invention addresses is corrosion in the boiler exhaust stack 14. If steam demands in the boiler system are such that there is occasion to operate at very low firing rates for extended periods of time, low exit gas temperatures from the economizer could result. Although the economizer itself may be protected by adequate feedwater temperatures, the stack may be susceptible to acid corrosion. The temperature of the metal, or stack wall, in contact with the flue gas will determine the extent of acid corrosion. A heat sensitive thermostat 44 is located in the stack 14. A temperature control valve 46 connected to the thermostat 44 controls the amount of steam that enters the preheater 26 through conduit 47. This control valve 46 is activated by a low flue gas temperature and will minimize the possibility of corrosion in the exhaust stack 14.

If, for instance, low exit flue gas temperature from the economizer 12 cause the corrosive acids to condense in the stack 14 from the flue gas 18, more steam can be introduced into the preheater 26 to heat the feedwater 20 going into the economizer 12. With higher feedwater temperatures going into the economizer, the gas/feedwater temperature differential is reduced. Therefore, less heat is extracted from the flue gas 18 and the gas that exits is elevated in temperature.

The control valves 40 and 46 are arranged in parallel. Under ordinary operating conditions, the valve 46 is closed and the valve 40 controls the amount of steam entering the preheater 26. Only under low load conditions will the valve 46 "override" and allow a greater amount of steam to enter the preheater. When both control valves 40 and 46 are open, a greater amount of steam will enter the preheater than when only the downstream preheater valve 40 is open.

Whereas, the present invention has been described in particular relation to the drawings attached hereto, it should be understood that other and further modifications of the invention, apart from those shown or suggested herein, may be made within the spirit and scope of this invention.

What is claimed is:

1. In a boiler system which includes a boiler for boiling feedwater therein to produce steam, an exhaust stack connected to said boiler for removing flue gas therefrom, and a fuel economizer mounted in said stack for preheating feedwater in said economizer prior to introduction of said feedwater into said boiler, and wherein said fuel economizer preheats the feedwater therein by passing the feedwater in heat exchange with flue gas from the boiler; an improved method of preheating said feedwater prior to its introduction into said economizer which comprises passing said feedwater through a preheater heat exchanger prior to its introduction into said economizer, conducting a first portion of steam from said boiler through a first conduit and into said preheater heat exchanger to heat said feedwater therein, conducting a second portion of steam from said boiler through a second conduit and into said preheater heat exchanger to heat said feedwater therein, controlling the flow of steam through said first conduit in response to the temperature of feedwater entering said economizer whereby the temperature of the feedwater entering said economizer is above the dew point of the corrosive acids in the flue gas passing through said economizer, and controlling the flow of steam through said second conduit in response to the temperature of the exit gas from said exhaust stack to maintain the temperature of the flue gas above a predetermined temperature which will minimize corrosion within the exhaust stack due to the condensation of corrosive acids therein.

2. In a boiler system which includes a boiler for boiling feedwater therein to produce steam, an exhaust stack connected to said boiler for removing flue gas therefrom, and a fuel economizer mounted in said stack for preheating feedwater in said economizer prior to introduction of said feedwater into said boiler, and wherein said fuel economizer preheats the feedwater therein by passing the feedwater in heat exchange with flue gas from the boiler; apparatus for preheating said feedwater prior to its introduction into said economizer which includes a preheater heat exchanger, means for conducting said feedwater through said preheater heat exchanger prior to its introduction into said economizer, a first conduit connected from said boiler to said preheater heat exchanger for conducting a first portion of steam from said boiler through said preheater heat exchanger for heating said feedwater therein, a second conduit connected from said boiler to said preheater heat exchanger for conducting a second portion of steam from said boiler through said preheater heat exchanger for heating said feedwater therein, a first temperature control valve in said first conduit for controlling the flow of said first portion of steam therethrough, a second temperature control valve located in said second conduit for controlling the flow of said second portion of steam therethrough, means responsive to the temperature of said feedwater prior to entering said fuel economizer for controlling the operation of said first temperature control valve to permit the flow of said first portion of steam through said first conduit whereby the temperature of said feedwater is maintained above a predetermined temperature prior to entering said fuel economizer, and means responsive to the temperature of the exit gases from said exhaust stack for controlling said second temperature control valve to permit the flow of said second portion of steam through said second conduit to maintain the temperature of said flue gas above a predetermined temperature.

* * * * *